United States Patent [19]

Nakamura et al.

[11] 4,041,112

[45] Aug. 9, 1977

[54] CARBURETOR FOR VEHICLE ENGINES

[75] Inventors: Akihisa Nakamura, Ohizumigakuen; Takashi Kamezaki, Tokyo; Kenji Naito, Kawasaki; Kunichika Usui, Asaka, all of Japan

[73] Assignee: Honda Giken Kogyo Kabushiki Kaisha, Tokyo, Japan

[21] Appl. No.: 681,268

[22] Filed: Apr. 28, 1976

[30] Foreign Application Priority Data

Apr. 28, 1975 Japan ..... 50-50640

[51] Int. Cl.[2] ..... F02M 5/14

[52] U.S. Cl. ..... 261/72 R; 261/DIG. 50; 137/38

[58] Field of Search ..... 261/DIG. 50, 72 R; 137/38

[56] References Cited

U.S. PATENT DOCUMENTS

| | | | |
|---|---|---|---|
| 1,744,580 | 1/1930 | Schiske | 261/72 R |
| 2,109,179 | 2/1938 | Michael | 261/72 R |
| 2,454,974 | 11/1948 | Mennesson | 261/72 R |
| 2,718,387 | 9/1955 | Carlson et al. | 261/DIG. 50 |
| 2,757,914 | 8/1956 | Ball | 261/DIG. 50 |
| 2,914,307 | 11/1959 | Eickmann | 261/DIG. 50 |
| 3,207,490 | 9/1965 | Sterner et al. | 261/DIG. 50 |
| 3,372,912 | 3/1968 | Benmore | 261/DIG. 50 |

*Primary Examiner*—Tim R. Miles

[57] ABSTRACT

An improved carburetor for vehicle engines of the down draft type having a suction duct connected to an intake manifold, a float chamber storing a predetermined constant quantity of engine fuel and arranged on one side of the suction duct in the transverse direction of a vehicle equipped with the carburetor, and a vertically extending fuel passage connected at one end to the float chamber and at the other end to a main fuel nozzle opening into the suction duct, the carburetor being capable of holding the fuel contained in the fuel passage at all times at a predetermined constant level for highly stabilized fuel supply to the engine irrespective of lateral or longitudinal inclinations of the fuel surface in the float chamber occurring under conditions of acceleration, deceleration or turning of the vehicle. To this end, the float chamber is formed such that the right and left halves of the chamber divided by an imaginary vertical plane through the axis of the fuel passage and which extends longitudinally of the vehicle, are equalized in effective volume to a substantial extent, whereas the front and rear halves of the chamber divided by an imaginary vertical plane through the main fuel nozzle and which extends transversely of the vehicle, are also substantially equalized in effective volume.

3 Claims, 3 Drawing Figures

CARBURETOR FOR VEHICLE ENGINES

FIELD OF THE INVENTION

This invention relates to carburetors for use with vehicle engines and more specifically to those of the type having a vertically extending suction duct connected with an intake manifold, a float chamber for fuel disposed on one side of the suction duct in the transverse direction of a vehicle equipped with the carburetor, and a fuel passage connected at one end with the float chamber and at the other end with a main fuel nozzle opening into the suction duct.

SUMMARY OF THE INVENTION

This invention is intended to provide a novel and improved carburetor for vehicle engines which is capable of holding the level of the fuel in the fuel passage connecting the float chamber with the main fuel nozzle substantially constant even when the normal level surface of the fuel in the float chamber is caused to incline under the action of centrifugal or intertial forces occurring during various operating conditions of the vehicle including acceleration, deceleration and turning thereof.

To achieve the above objective, according to the invention, there is provided a carburetor of the type described in which the float chamber is formed such that the right and left halves of the chamber divided by a vertical plane through the axis of the fuel passage and which extends longitudinally of the vehicle, are substantially equalized in effective volume, whereas the front and rear halves of the chamber divided by a vertical plane through the axis of the vertical fuel passage and which extends transversely of the vehicle, are also equalized in effective volume to a substantial extent.

Other objects, features and advantages of the present invention will be more fully understood from the following detailed description, when taken in conjunction with the accompanying drawings, which illustrate an exemplary embodiment of the invention.

DESCRIPTION OF THE PREFERRED EMBODIMENT

Figure 1:
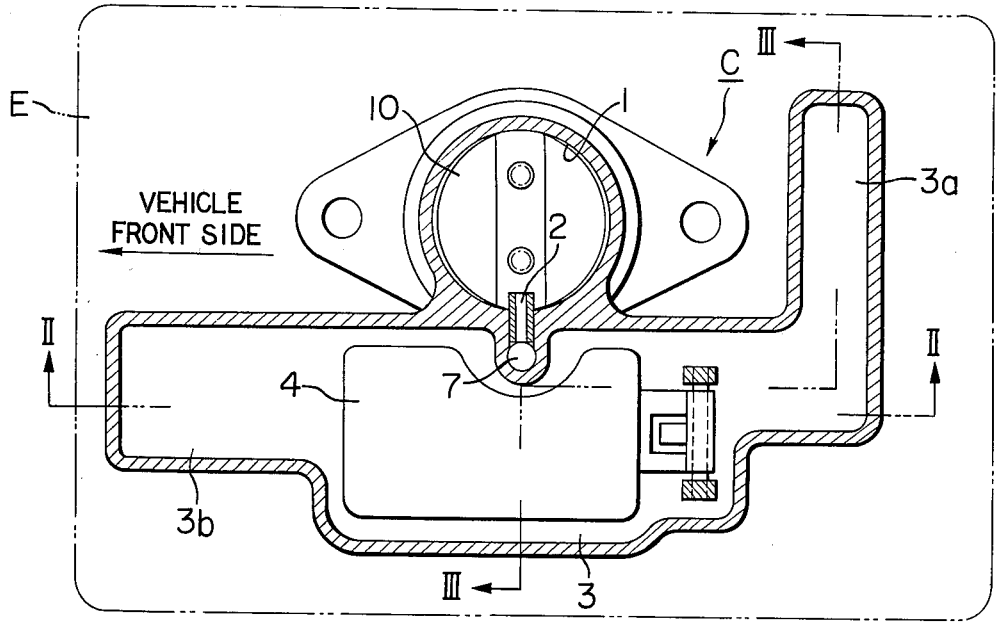
FIG. 1 is a cross sectional plan view of a preferred form of a carburetor according to the invention.
Figure 2:
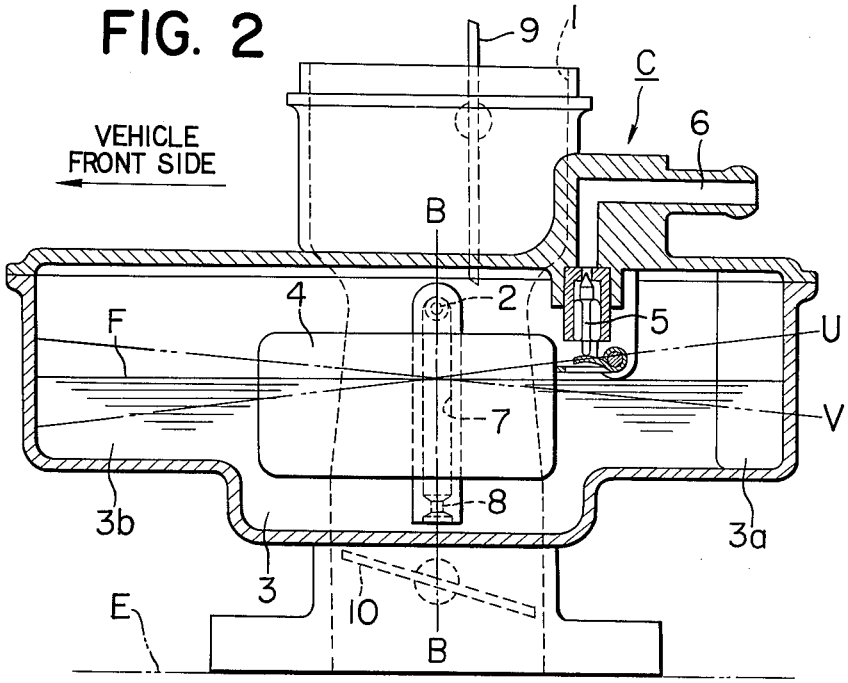
FIG. 2 is a vertical sectional view taken along line II—II in FIG. 1.

Referring to the drawings, there is shown a carburetor, generally designated at C, which is mounted on an engine E of an automotive vehicle. In FIGS. 1 and 2, the left-hand side represents the front side of the vehicle. The carburetor C is designated to be of the down draft type having a vertically extending suction duct 1 connected to an intake manifold. Disposed on one side of the suction duct 1 in a direction transversely of the vehicle, is a float chamber 3 in which fuel fed thereto from a fuel tank (not shown) through a feed inlet passage 6 and a float valve 5 is stored at a predetermined constant level regulated under the action of the float valve 5 operable in response to rising and falling movements of a float 4 floating on the fuel surface, as is conventional in the art concerned.

Opening into the fuel chamber 3 in a position below the normal fuel level is a vertically extending fuel passage 7 through a fuel metering main jet 8 formed at the lower end thereof, the passage being connected at the upper end thereof with the main fuel nozzle 2 arranged to open into the suction duct 1.

For purposes of compensation for fuel surface inclinations, the float chamber 3 has such a construction that the rear end portion 3*a* thereof is bent toward the adjacent rear side of the suction duct 1 transversely beyond an imaginary vertical plane A—A (see FIG. 3) through the axis of the vertical fuel passage 7 and extending longitudinally of the vehicle to form a lateral extension so that the effective volumes of the right and left halves of the chamber divided by the plane become substantially equal to each other, whereas the front end portion 3*b* thereof is properly extended in the longitudinal direction of the vehicle so as to substantially balance or equalize the effective volumes of the front and rear halves of the chamber divided by an imaginary vertical plane B—B (see FIG. 2) on which the axis of the fuel passage 7 lies and which extends tranversely of the vehicle.

In the drawings, reference numerals 9 and 10 designate a choke valve and a throttle valve, respectively, which are arranged in the suction duct 1 on opposite sides of the main fuel nozzle 2.

Figure 3:
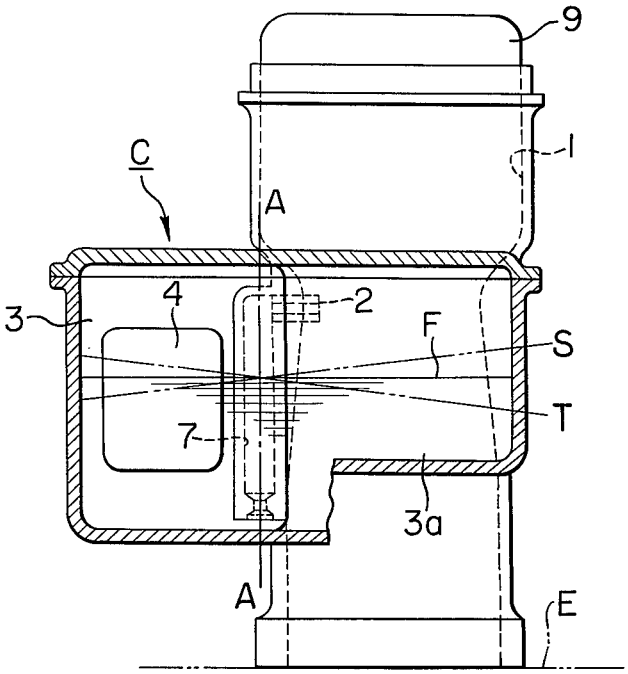
FIG. 3 is a vertical sectional view taken along line III—III in FIG. 1.

In operation of the inventive carburetor described above, when a vehicle equipped with the carburetor C is steered to make a turn, the normal level fuel surface F is caused to incline sidewise, as shown by chain-dotted lines S and T in FIG. 3, under the action of centrifugal forces, but on this occasion, the point, at which the axis of the vertical passage 7 and the plane of the fuel surface now inclined meet, is held practically constant or unchanged, as in the case of the vehicle running straight at a constant speed, due to the fact the right and left halves of the float chamber 3 divided by the longitudinally extending vertical plane A—A are equal in effective volume to each other because of the laterally bent formation of the rear end portion 3*a* of the chamber. As a consequence, the height or level of the fuel in the fuel passage 7, or hence the distance between the fuel surface in the fuel passage 7 and the main fuel nozzle 2, is always held substantially constant under various operating conditions of the vehicle to stabilize the fuel supply from the main fuel nozzle 2 to the suction duct 1, thereby ensuring the improved engine operation.

Further, in the case of acceleration or deceleration of the vehicle, where the normal level fuel surface F is caused to incline under inertial effects in the longitudinal direction, for example as shown by chain-dotted lines U and V in FIG. 2, there will not be any practical change in height of the fuel in the fuel passage 7, and hence the distance between the main fuel nozzle 2 and the fuel surface in the fuel passage 7 will be held unchanged to a practical extent, due to the fact that as stated hereinbefore, the front and rear halves of the float chamber 3 divided by the laterally extending vertical plane B—B on the opposite sides thereof are equal in effective volume to each other. Accordingly, in this case, the fuel supply from the main nozzle 2 to the suction duct 1 is also stabilized to a practical extent.

As described in the foregoing, according to the present invention, the float chamber 3 of the carburetor C, disposed on one side of the suction duct 1 in the transverse direction of the vehicle and connected with one end of the vertical fuel passage 7, which in turn is connected at the other end with the main fuel nozzle 2 opening into the suction duct 1, is designed to have such a construction that the rear end portion 3*a* thereof is bent toward the adjacent side of the suction duct 1 so as to extend laterally beyond the axis of the fuel passage 7 to form a lateral extension serving to compensate for fuel level changes, whereas the front end portion 3*b* is properly elongated in the forward direction of the vehicle so as to balance the increased volume of the lateral extension. With such construction, it is possible to minimize any change in fuel rise or the distance between the main fuel nozzle 2 and the fuel surface in the fuel passage 7 to a substantial extent even during acceleration, deceleration or turning of the vehicle. This permits the engine to exhibit constant performance as desired irrespective of the operating conditions of the vehicle.

While only one embodiment of the present invention has been shown and described, it will be apparent to those skilled in the art that various changes and modifications may be made therein as required without departing from the spirit of the invention or the scope of the appended claims.

What is claimed is:

1. A carburetor for vehicle engines comprising a suction duct, a single float chamber disposed adjacent one side of the suction duct, a vertically arranged main fuel passage opening into said float chamber, a main fuel nozzle communicating with said fuel passage and opening into the suction duct, and a single float member arranged to float on the surface of fuel in said float chamber for regulating the fuel therein at a constant level, said float chamber having one longitudinal end portion bent toward the adjacent side of said suction duct to project transversely beyond said main fuel nozzle so as to form a lateral extension, and another end portion elongated in the longitudinal direction to compensate for the increased volume of said lateral extension, so that front and rear halves of said chamber divided by a transversely extending vertical plane passing through the vertical axis of said main fuel passage are substantially equal in effective volume to each other, the lateral halves of said chamber divided by a longitudinally extending vertical plane passing through the vertical axis of said main fuel nozzle being substantially equal in effective volume to each other whereby a substantially constant level of fuel can be maintained in said main fuel passage during acceleration, deceleration, or turning of the vehicle.

2. A carburetor for vehicle engines according to claim 1, wherein said fuel nozzle is disposed at an upper level in said float chamber.

3. A carburetor as claimed in claim 1, wherein said main fuel passage and said main fuel nozzle are aligned in a common transverse plane.

* * * * *